United States Patent [19]

Schiessl et al.

[11] 4,015,355

[45] Apr. 5, 1977

[54] INCENDIARY PROJECTILE AND MANUAL LAUNCHER

[75] Inventors: Alois Schiessl, Bad Reichenhall; Hartmut Krone, Bayrisch Gmain, both of Germany

[73] Assignee: Firma Buck K.G., Germany

[22] Filed: Mar. 14, 1975

[21] Appl. No.: 558,236

[30] Foreign Application Priority Data

Mar. 14, 1974 Germany ..... 2412346

[52] U.S. Cl. ..... 42/1 F; 102/65.2; 102/90

[51] Int. Cl.[2] ..... F41F 27/00

[58] Field of Search ..... 42/1 F; 102/65, 65.2, 102/66, 90

[56] References Cited

UNITED STATES PATENTS

| | | | |
|---|---|---|---|
| 3,677,181 | 7/1972 | Giljarhus et al. | 102/66 X |
| 3,683,815 | 8/1972 | Shaffer | 102/66 X |

*Primary Examiner*—Stephen J. Lechert, Jr.

*Attorney, Agent, or Firm*—Burns, Doane, Swecker & Mathis

[57] ABSTRACT

An incendiary projectile carries an incendiary charge and a control charge arrangement for igniting and disintegrating the incendiary charge. The control charge arrangement is ignited by the propellant charge which launches the projectile and then immediately ignites the incendiary charge and finally causes disintegration of the projectile. In one embodiment the control charge comprises a first charge, including a glow and delay composition, and a disintegrating charge which is ignited by the first charge. In another embodiment the control charge comprises a glow and delay composition which ignites and then heats the incendiary charge to produce disintegration of the projectile. A novel tubular housing for the control charge is provided to prevent premature disintegration and minimize atomation of the incendiary charge.

28 Claims, 5 Drawing Figures

INCENDIARY PROJECTILE AND MANUAL LAUNCHER

BACKGROUND AND OBJECTS OF THE INVENTION

The invention relates to a manual firing device and, more particularly, to a projectile launcher having a handle, a propellant charge preferably subdivided and ignitable, and a projectile which can be ejected by the charge, the projectile having a relatively high weight as compared to the other parts of the device.

It has recently become possible, particularly as a result of previously unpublished proposals of subdividing the propellant charge of a manually operated firing device, to fire projectiles of a considerable weight for relatively large distances, e.g., up to a maximum of 120m. (See for example U.S. application Ser. No. 429,738, filed Jan. 2, 1974 and assigned to the assignee of this invention.) In this case, we are dealing generally with projectiles having a fog or smoke producing charge.

In view of the above-mentioned increased range, it would also be desirable to fire projectiles having an incendiary charge. However, in that case difficulties result. The incendiary projectile should ignite when striking a hard object. On the other hand, it should disintegrate automatically in the air after a certain time of flight. At the same time, one cannot use the usual disintegrating fuse ignitors, e.g., clockwork fuses and percussion fuses, for reasons of economy and weight. To this must be added that the incendiary charge of the projectile must be ignited shortly after the discharge in order to guarantee that the incendiary projectile will have its full incendiary effect even in the case of the shortest striking distances, e.g., a target distance of 8 m.

It is, therefore, an object of the present invention to provide an incendiary projectile launcher which minimizes problems of this sort.

It is another object of the invention to create a manual firing device of the initially mentioned type for launching an incendiary projectile, wherein the incendiary projectile has a relatively large range, will disintegrate automatically after a predetermined flight time, or as a result of the force of target impact, and which in all cases even in the case of the shortest striking distance will guarantee a perfect ignition of the incendiary charge and which nevertheless can be produced simply in its structure and relatively cheaply.

BRIEF SUMMARY OF THE PREFERRED EMBODIMENTS OF THE INVENTION

According to the invention, these objects are accomplished through the fact that an incendiary charge is housed in a casing. A control charge is housed in the casing and is arranged to be ignited by the propellant charge of a hand launcher, immediately ignite the incendiary charge, and cause disintegration of the projectile at a predetermined interval after igniting the incendiary charge.

In a preferred embodiment, a projectile consists of an easily deformable casing which, upon striking, disintegrates mechanically essentially over its entire length, an incendiary charge and disintegration charge housed in the casing, a first charge including a glow and a delaying composition ignitable by the propellant charge and for igniting first the incendiary charge and then the disintegrating charge. In the case of firing this incendiary projectile, the propelling charge therefore first ignites the first charge, including the glow and delaying composition, which on its part ignites the incendiary charge. With this it will be assured that the incendiary charge is ignited already shortly after the projectile leaves the projector and thus is fully effective even if the projectile strikes a hard object already after a minimal distance of flight (e.g., 8 m) and its casing disintegrates mechanically upon striking. The glow and delaying composition ignites the disintegrating composition, naturally on the assumption that during the delaying time of the delaying composition the projectile does not strike a hard object. Therefore, the incendiary projectile will become effective within a certain range, e.g., between 8 m and 100 m upon impact or else in case of exceeding this range even without impact. This automatic disintegration not only excludes the development of dangerous duds, but it makes possible special combat measures perhaps by ignition above the target.

The casing of the projectile can be a metal tube, preferably an aluminum tube with attenuating grooves running in a longitudinal direction. With this, an effective disintegration of the casing over its essentially entire length will be assured.

According to a particularly effective development of the invention, the glow and delay composition comprise a single compound. In that case, it will be advantageous that the glow compound and the disintegrating charge are housed in a small metal tube, preferably a small aluminum tube, penetrating the incendiary charge axially. The wall of the tube is reinforced in the area of the glow composition and has perforations. At the same time, then, the glow and delay compound ignites the incendiary charge by way of the perforations of the small tube and after an adjustable delaying time it ignites the disintegrating composition housed adjacent in the same small tube. As a result of the reinforcement of the wall of the small tube in the area of the glow and delay compound, one will achieve that no premature ignition of the disintegrating composition takes place by way of the wall of the small tube which is heating up. In the area of the disintegrating composition, however, the wall of the small tube is to be relatively thin, so that at the explosion of the disintegrating composition the disintegrating force is as low as possible. This will avoid an improper atomization of the firing mass.

According to another embodiment of the invention, the incendiary charge consisting essentially of phosphorus is enclosed in a gas-tight manner in the projectile casing. The glow and delay composition serves to disintegrate the incendiary charge. In this case, the glow and delay composition heats the part of the incendiary charge not yet ignited in such a way that, as a result of the evaporation of the phosphorus, such an excess pressure develops in the casing which is closed in a gas-tight manner. Eventually, the casing finally will tear open and release the ignited incendiary charge. The glow and delay composition at the same time can be housed in a small metal tube, preferably a small aluminum tube, penetrating the incendiary charge axially. It is advantageous and necessary in the case of an aluminum casing to attach a layer of thermally insulating material, preferably asbestos paper on the inside of the projectile casing in order to exclude any premature softening or melting of the projectile casing as a result of heat action from the inside.

In the case of the invention, it is finally of considerable significance to cover up the firing barrel in such a way that the incendiary projectile will be absolutely fixed and protected in the tube prior to firing. The cover, however, during ignition of the propelling charge will offer only a mechanical resistance to the projectile without there being any need to remove the cover prior to firing or without there being any danger to the rifleman as a result of covering parts flying all over the place. According to the invention, therefore, a muzzle cap connected undetachably with the firing tube and made of elastic material has been provided. The bottom of this cap covers up the muzzle opening and is subdivided in such manner that the individual parts of the bottom can be snapped to the outside of the projectile driven by the propellant charge.

Preferably, the hand launcher includes a divided propellant charge wherein one portion thereof, a thrust portion, is carried by the projectile.

THE DRAWING

In the drawing two embodiments of the invention are shown schematically:

DETAILED DESCRIPTION OF THE PREFERRED EMBODIMENTS

Figure 1A:
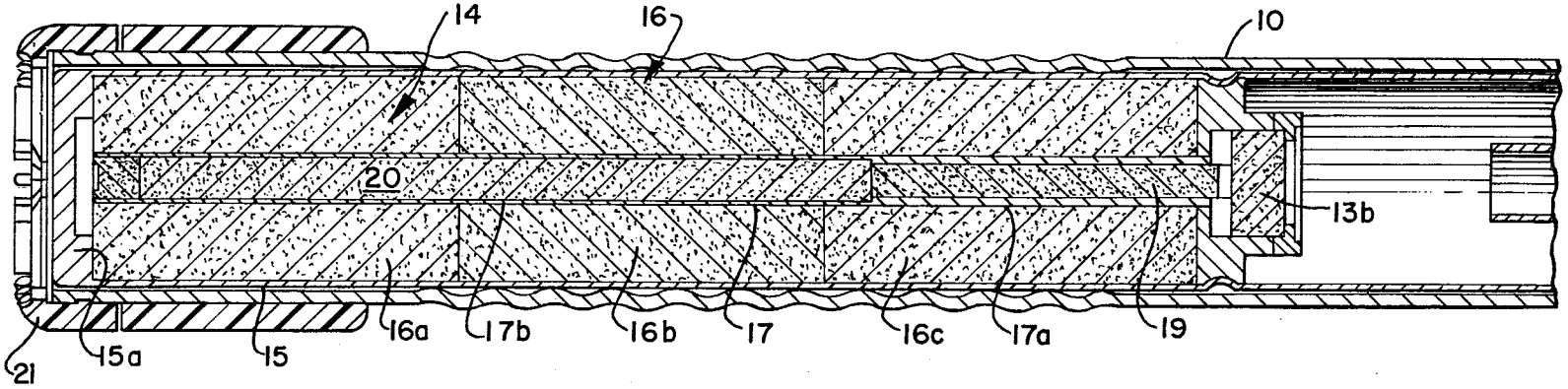
FIGS. 1A and 1B show a first embodiment of the launcher and projectile according to the invention in longitudinal section.
Figure 1B:
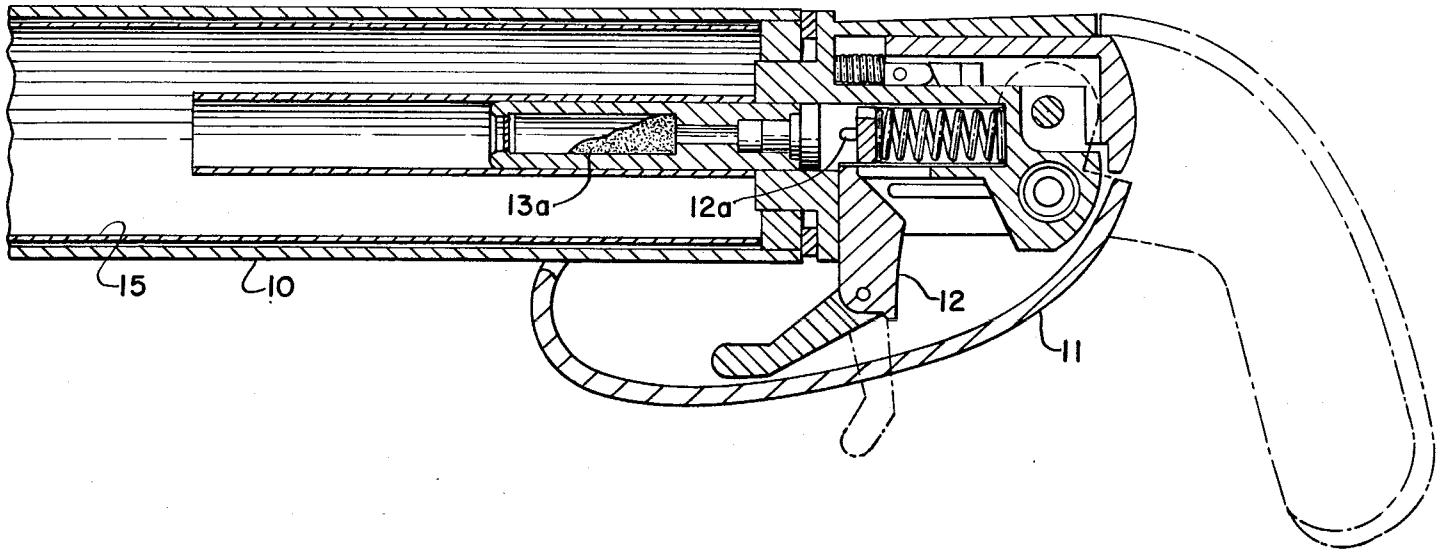

According to FIGS. 1A and 1B the manual launching device consists essentially of a launching tube or barrel 10, a handle 11 which can be snapped on, and a trigger 12. In the launching barrel 10, a subdivided propellant charge 13*a*, 13*b* and an incendiary charge projectile 14 are housed. The propellant charge is subdivided into an initial charge 13*a* attached to the device and an untamped thrust charge 13*b* connected with the bottom of the projectile 14.

In case of operation of the trigger 12, a customary firing pin 12*a* strikes a customary percussion cap and fires the initial charge 13*a*. The combustive products of this charge strike and act upon the projectile 14 and thereby ignite the thrust charge 13*b* connected with the bottom of the projectile. The thrust charge 13*b* then accelerates the projectile 14 to the desired muzzle velocity.

The spatial distance between the initial charge 13*a* and the thrust charge 13*b* is dimensioned such that the effects of the thrust charge, to be sure, will start to occur only after the initial charge 13*a* acts upon the projectile 14. This happens in good enough time so that the thrust charge 13*b* can still burn down completely, while the projectile 14 is in the barrel 10. In this manner, one will achieve that individual heavy projectiles 14 shaped unfavorably from an aerodynamic point of view, can be shot to about 120 m without the recoil exceeding a measure bearable for the rifleman. Attention is directed to the previously mentioned U.S. application Ser. No. 429,738 for a detailed review of this concept.

The incendiary charge projectile 14 comprises essentially a casing 15 having a front cover 15*a* and an incendiary charge 16 housed in the casing. The charge 16 preferably comprises three compressed sections 16*a*, 16*b*, and 16*c*.

A small tube 17 penetrates axially the incendiary charge 16. The thickness of the wall of this tube is variable, with the portion of the wall 17*a* adjacent to the propellant charge 13*b* being reinforced, i.e., considerably thicker than the remaining portions of the wall 17*b*. A first charge 19 is housed in the small tube 17 within the reinforced area of the wall portion 17*a*. A disintegrator charge 20 fills the remaining portion 17*b* of the tube 17. A lid 22 closes the muzzle of the launching barrel 10 and holds the projectile 14 firmly in the barrel 10 prior to its launching.

The casing 15 of the projectile is formed preferably of aluminum and has longitudinal grooves running essentially across the entire longitudinal extent of the projectile. The small tube 17 is also preferably formed of aluminum, whereby the portion of the wall 17*b* is thin like a foil, whereas the wall portion 17*a* has multiple strength of the former part 17*b*.

The incendiary charge 16 comprise compressed objects made of a mixture of phosphorus, magnesium, iron oxide. As an example for the composition of an incendiary charge, we can list the following:

| | |
|---|---|
| Phosphorus red | 70 parts by weight |
| Magnesium | 20 parts by weight |
| Iron oxide, purified | 12 parts by weight |
| Chloroparaffin, liquid | 6 parts by weight |
| Chloroparaffin, solid | 4 parts by weight |

The first charge 19 has as its function the ignition of the incendiary charge 16 and the later ignition of the disintegrator charge 20. Preferably, the first charge comprises a glow and delaying composition. The first charge is arranged so that when it is ignited by the thrust charge 13*b*, it first ignites the incrediary charge and then burns down toward the disintegrator charge 20.

The first charge 19 can, if desired, comprise a glow and delaying composition in which first a glow compound is ignited by the thrust charge 13*b* and then ignites the incendiary charge 16, and secondly a delaying compound is ignited by the glow compound and then burns down toward the disintegrator charge 20.

Preferably, though, the glow and delaying composition of the first charge 19 comprises a single glow and delaying compound comprising preferably red lead and silicon. As an example of a suitable glow and delaying compound, we can list:

| | | |
|---|---|---|
| Red lead | 87 | parts by weight |
| Silicon | 12.5 | parts by weight |
| Shellac | 0.5 | parts by weight |

whereby it is essential that the silicon be finely ground and has a reproducible distribution of its grain size, whereby about 60% are to be below a grain size of 10 microns.

As a disintegrator composition 20, any composition is suitable which explodes in an untamped condition, preferably a mixture of magnesium and lead dioxide. As an example for a disintegrator composition, we can list:

| | | |
|---|---|---|
| Magnesium | 24.5 | parts by weight |
| Lead dioxide | 74.5 | parts by weight |
| Finely divided silica (Aerosil brand) | 1.0 | parts by weight |

whereby the grain size of the magnesium powder is to be below 75 microns.

In the case of launching, as mentioned further above, the initial charge 13*a* ignites the thrust charge 13*b*, the latter imparting the final muzzle velocity to the projectile 14. While burning down, the thrust charge 13*b* now ignites the glow and delaying composition 19 being in connection with it. The composition 19, on its part, during its burning down ignites the incendiary charge 16. This can be expedited by providing small bores in the wall portion 17*a* of the tube 17. Whenever the composition 19 has almost burned down, it additionally ignites the disintegrator composition 20 adjacent to it, which then explodes and disperses the already ignited incendiary charge 16 while tearing open the casing 15 of the projectile. But whenever ever the projectile 14 strikes a hard object before the glow and delaying composition 19 has burned down to the disintegrator composition 20, the projectile casing 15 is torn open through the impact and the already ignited incendiary charge is dispersed while igniting the disintegrator composition 20. Thus, because the glow and delaying composition 19 already starts to ignite the incendiary charge immediately after its ignition by the thrust charge 13*b*, a full incendiary effect of the projectile will result even if the latter strikes a target shortly after its emergence from the launching tube 10, say after a flight of 8 m.

On the other hand, however, the glow composition 19 also represents a delaying composition because after it has completely burned down after a certain delaying time, it will then ignite the disintegrator composition 20 as a result of which the projectile 14 explodes in the air without impact after a definite predetermined period corresponding to a flight range of about 90 m.

At the same time, considerable significance is ascribed to the variable dimensioning of the thickness of the wall of the small tube 17. As a result of the comparatively great thickness of the wall in the area 17*a*, one will ensure that no premature ignition of the disintegrator composition 20 takes place across the wall of the small tube, such as by too great a heat transfer through the tube.

The reason for the very slight dimensioning of the thickness of the wall of the small tube 17 in the area 17*b* on the other hand is the intent to impose the least possible resistance to the clouds of the disintegrator composition produced by the explosion. Whenever the thickness of the wall of the small tube 17 in the area of 17*b* is too great, then during the ignition of the disintegrator composition, the disintegrator force would be so strong that an atomization of the incendiary mass takes place. It is preferred, however, that this mass be distributed in the form of lumps.

It will be apparent that the glowing and delaying composition 19 constitutes a first charge, and that such first charge, together with the disintegrating charge 20 constitute a control charge.

Figure 2:
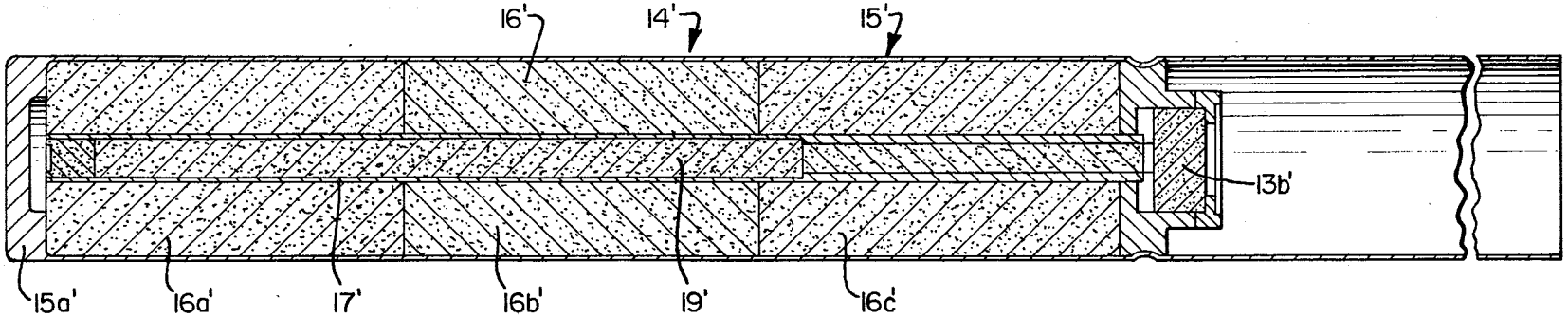
FIG. 2 shows a second embodiment of the incendiary projectile in longitudinal section.

In FIG. 2 a modified form of the incendiary projectile 14' is shown. In the case of this modified embodiment, no special disintegrator composition has been provided. The disintegration takes place rather as a result of the incendiary charge itself. This is accomplished in such a way that the glow and delaying composition 19' ignites the incendiary charge and heats it, whereby then such a pressure head occurs as a result of the partial evaporation of the incendiary mass, that the casing 15 will be torn open after a certain period of time. In order to achieve this, certain measures are required. Thus, the casing 15' must enclose the incendiary charge 16' in a gas-tight manner, so that an inside pressure head can be built up. Furthermore, the incendiary charge 16' must consist of an incendiary mass which, for a great part, can be evaporated. Best suited for this purpose is an incendiary mass which predominantly comprises phosphorus. The small tube 17' penetrating the incendiary charge 16' axially is filled completely with the glow composition 19'. Therefore glow composition is disposed also in the area which in the case of the embodiment according to FIG. 1 contains disintegrator composition. Variable thicknesses of the wall of the small tube 17' are not required here, rather one can get along with a uniform thickness of the wall.

Upon launching of the incendiary projection of FIG. 2, the glow and delaying composition 19' is ignited by the thrust charge 13*b'* and, on its part, ignites portion 16*c'* of the incendiary charge 16'. Bores can be provided in the tube 17' to facilitate the ignition of the charge 16'. In case of its further burning down in a forward direction toward the lid 15*a'*, the glow composition 19' heats the portions 16*b'*, 16*a'* of the incendiary charge 16', which have not yet been ignited. In so doing, the phosphorus contained in the incendiary mass evaporates partly and, as a result of that, a pressure head develops in the casing 15' which indeed has been closed in a gas-tight manner. After a definite delaying time, this pressure head acquires such a magnitude that the casing 15' is exploded or torn open, that is to say a disintegration takes place.

The method of functioning of the incendiary projectile according to FIG. 2 corresponds essentially to that of the incendiary projectile of FIG. 1. Whenever the incendiary projectile encounters an obstacle even a short time after its launching, then a mechanical disintegration of the casing 15' occurs as a result of the impact force. If on the other hand, the projectile does not encounter an obstacle within a predetermined period of time, then the projectile is disintegrated in the air as a result of the inside pressure head of the evaporated phosphorus. Either way, a full incendiary effect occurs.

In order to ensure that the heat developing during the burning down of the small glow tube should not have an effect on the projectile casing and that as a result of that no hole develops through which the pressure head escapes, the inside wall of the casing 15' is preferably covered up with a layer of heat damping material (not shown) e.g., asbestos paper. Another possibility for preventing this consists in making the tube 15' of a heat damping, easily breakable material, rather than aluminum.

It will be apparent that the glow and delaying composition 19' constitute a control charge.

Figure 3:
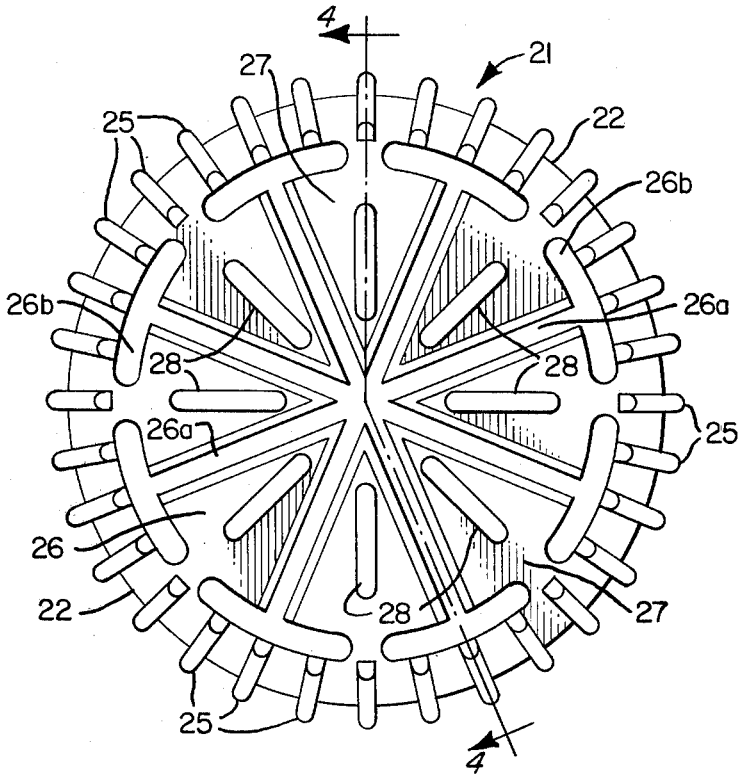
FIG. 3 is a front view of the muzzle lid of FIG. 1.
Figure 4:
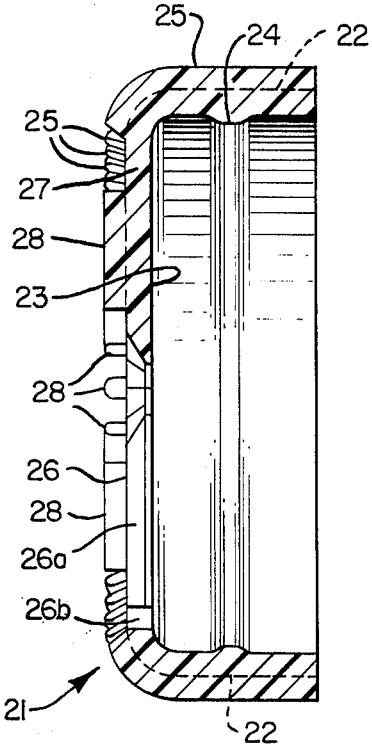
FIG. 4 is a sectional view of the lid taken along line 4—4 of FIG. 3.

During the above description of the embodiment according to FIG. 1 and given by way of example, it had been mentioned that the incendiary projectile 14 is fixed prior to launching in the barrel 10 by the muzzle lid 21. The construction of this lid 55 21 is of significant importance for the functioning capability of the invention as becomes clear from the subsequent explanation. Prior the launching, the lid 21, as has been mentioned, must fix the projectile 14 in the barrel 10. Additionally, it must protect it against impacts in such a way that in case of a drop from a height of 2 m no damage will occur. At the launching on the other hand, the lid 21 must permit an almost unimpeded emergence of the incendiary projectile 14 from the muzzle of the barrel 10, because in the case of the subdivided propellant charge used, the initial thrust is very low as a result of the initial charge 13*a*. Furthermore, it must be ensured that in case of firing, no parts of the lid separate, because the lid parts would fly about an endanger the rifleman. These partially contradictory requirements made of the lid 21 before and during firing cannot be circumvented by removing the lid, because the military requirements require that the manually fired device be ready for firing at any time and without removal of any parts whatever. The lid 21, best illustrated in FIGS. 3 and 4, meets all these requirements.

The lid 21 comprises essentially of a side section or cap ring 22 enclosing the frontal marginal area of the barrel 10 and an end section or bottom 23 covering up the muzzle of the barrel 10. The cap ring 22 has an inside annular bead 24, as well as outside ribs 25 running generally parallel to the longitudinal axis of the barrel 10. These ribs 25 are bent over and around an edge or bight portion of the lid which unites the bottom 23 and the ring 22 of the cap.

The bottom 23 of the cap consists of a multiplicity of equal individual parts 26 in the form of isosceles triangles. The triangles are defined by apertures which are formed in the bottom 23. Each aperture includes a radial portion 26*a* and a circumferential portion 26*b* which cooperate to form a T-shaped aperture. The triangles 26 (in the drawing eight such triangles have been shown) lie with their sides abutting against one another and meet together centrally with their apex points in such a way that a polygon (in the preferred case an octagon) develops with the base sides of the triangles defining the sides of the polygon. Each of the triangles 26 is connected on its base side with the cap ring 22 by way of a bridge surface 27. Moreover, each triangle 26 has an elevated reinforcing rib or tube 28 extending generally radially. The arrangement is made such, that the bottom 23 is completely flat or has a slight incidence or curvature toward the outside, in the present instance the bottom is in the form of a very flat octagon-pyramid.

The lid 21, comprising a hard elastic plastic, is stuck onto the barrel 10, whereby it engages firmly with its annular bead 24 within an annular groove located on the barrel 10 or behind an annular bead located on the barrel 10 with a simultaneous contact pressure of a rubber gasket. The installed lid 21 retains the projectile 14 in the barrel 10 and protects it against impact. Experiments have shown that, even in the case of a drop from 2 m, the force of the fall is largely absorbed particularly by the ribs 25, so that the projectile 14 remains undamaged. In the case of firing, however, the slight thrust by the projectile accelerated by the initial charge 13*a* suffices to allow the triangles 26 to bead or snap to the outside, so that the projectile 14 can emerge from the barrel muzzle almost without resistance, but certainly without significant resistance.

Instead of using apertures 26*a*, 26*b* of the type shown, the bottom 23 can merely be slit along these regions to define abutting edges. Alternatively, the bottom 23 can be only weakened along these regions by the use of deep indentations or grooves so that a minimal amount of force will be needed to break through the lid.

In order to achieve protection against moisture, a thin rubber disc covering the seams between the individual parts of the bottom can be attached on the inside of the bottom 23 of the lid.

SUMMARY OF MAJOR ADVANTAGES AND SCOPE OF THE INVENTION

The projectile according to the present invention guarantees a dispersement of ignited incendiary charge material absent the need for an impacting of the projectile. The present charge arrangement assures that immediately upon being launched, the projectile carries an ignited charge of incendiary material and is gradually approaching a disintegrating condition. Subsequent disintegration, whether by impact or by internal explosion, assuredly ejects ignited incendiary pieces. The novel tubular housing arrangement for the glow and delay composition prevents premature disintegration and minimizes atomization of the incendiary charge upon disintegration.

The lid 21 provides an uncomplicated but effective means of retaining the projectile within the launcher in a manner which facilitates ejection of a projectile by the propellant charge.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A hand fired projectile launcher comprising a handled launching barrel, a propellant charge, triggering means for igniting said propellant charge, and a projectile disposed in said barrel, said projectile being of relatively high weight in comparison to other components of said launcher, the improvement wherein said projectile comprises:

a casing formed of an easily deformable material capable of disintegrating along substantially its entire length in response to impact, an incendiary charge disposed in said casing, an explosive disintegrator charge disposed in said casing and being suitable to explosively disintegrate said casing upon ignition, and a first charge including a glow and delaying composition arranged to:

be ignited to a burning condition by said propellant charge, ignite said incendiary charge, continue to burn for a predetermined period after ignition of said incendiary charge, and thereafter ignite said disintegrator charge to disintegrate the casing.

2. Apparatus according to claim 1 wherein said casing comprises a metallic tube having weakening grooves extending longitudinally therealong.

3. Apparatus according to claim 1 wherein said glow and delaying composition comprises a single compound.

4. Apparatus according to claim 3 wherein said projectile further includes a metal tube axially disposed within said incendiary charge; said tube carrying said glow and delaying composition in adjacently disposed relationship with said disintegrating charge; the portion of said tube carrying said glow and delaying composition having reinforced walls relative to remaining portions of said tube.

5. Apparatus according to claim 4 wherein said disintegrator charge comprises an untamped exploding mixture; the portion of said tube carrying said disintegrator charge having walls that are thinner than remaining portions of said tube.

6. Apparatus according to claim 5 wherein said disintegrator charge comprises a magnesium-lead oxide mixture; said glow and delaying composition comprising a silicon-lead oxide mixture; and said incendiary charge comprising a tamped mixture of phosphorus-metal oxide-paraffin.

7. Apparatus according to claim 1 wherein said propellant charge comprises an initial charge directly ignited by said triggering means and a thrust charge carried by said casing, said thrust charge being ignitable by said initial charge.

8. Apparatus according to claim 6 wherein said propellant charge comprises an initial charge directly ignited by said triggering means and a thrust charge carried by said casing, said thrust charge being ignitable by said initial charge.

9. Apparatus according to claim 1 wherein said projectile launcher further includes a muzzle lid formed of an elastic material, said lid being mounted on the muzzle of the barrel and including an end wall portion which retains said projectile against premature discharge from said barrel; said end wall portion comprising a series of elastically foldable parts which may be bent outwardly in response to the urgings of a projectile being launched by said propellant charge to permit discharge of said projectile.

10. Apparatus according to claim 9 wherein said lid further includes a ring portion integral with said end wall and extending around said barrel; said lid including a series of ribs extending along said ring portion in a direction generally parallel to the longitudinal axis of said barrel and curving inwardly along a bight portion of said lid which joins said end wall portion and ring portion.

11. Apparatus according to claim 9 wherein said foldable parts are shaped as isosceles triangles which abut against one another along their sides and at their apexes while forming a closed polygon; each foldable part being connected to said bight portion by means of a bridge section.

12. Apparatus according to claim 11 wherein said triangularly shaped parts include ribs extending generally radially.

13. Apparatus according to claim 10 wherein a thin membrane of waterproof material is attached on the inner side of said end wall portion.

14. A hand fired projectile launcher comprising a handled launching barrel, a propellant charge, triggering means for igniting said propellant charge, and a projectile disposed in said barrel, said projectile being of relatively high weight in comparison to the components of said launcher, the improvement wherein said projectile comprises:

a substantially gas-tight casing formed of an easily deformable material capable of disintegrating along substantially its entire length in response to impact, an incendiary charge disposed in said casing, a first charge including a glow and delaying composition arranged to:

be ignited to a burning condition by said propellant charge, and ignite and then heat said incendiary charge to develop a pressure head within said casing which, upon reaching a predetermined magnitude, explodes said casing subsequent to the igniting of said incendiary charge.

15. Apparatus according to claim 14 wherein said incendiary charge essentially comprises phosphorus.

16. Apparatus according to claim 15 including a metal tube extending axially through said incendiary charge; said first charge being housed in said tube.

17. Apparatus according to claim 15 including an inside lining of heat insulative material disposed on said casing.

18. Apparatus according to claim 17 wherein said heat insulative material comprises asbestos paper.

19. Apparatus according to claim 15 wherein said glow and delaying composition comprises a single compound.

20. Apparatus according to claim 19 wherein said glow and delaying composition comprises silicon-lead oxide.

21. Apparatus according to claim 14 wherein said propellant charge includes an initial charge ignited directly by said triggering means; and a thrust charge carried by said casing, said thrust charge being ignitable by said initial charge.

22. Apparatus according to claim 14 wherein said projectile launcher further includes a muzzle lid formed of an elastic material, said lid being mounted on the muzzle of the barrel and including an end wall portion which retains said projectile against premature discharge from said barrel; said end wall portion comprising a series of elastically foldable parts which may be bent outwardly in response to the urgings of a projectile being launched by said propellant charge to permit discharge of said projectile.

23. Apparatus according to claim 22 wherein said lid further includes a ring portion integral with said end wall and extending around said barrel; said lid including a series of ribs extending along said ring portion in a direction generally parallel to the longitudinal axis of said barrel and curving inwardly along a bight portion of said lid which joins said end wall portion and ring portion.

24. Apparatus according to claim 22 wherein said foldable parts are shaped as isosceles triangles which abut against one another along their sides and at their apexes while forming a closed polygon; each foldable part being connected to said bight portion by means of a bridge section.

25. Apparatus according to claim 24 wherein said triangularly shaped parts include ribs extending generally radially.

26. Apparatus according to claim 23 wherein a thin membrane of waterproof material is attached on the inner side of said end wall portion.

27. A hand fired projectile launcher comprising a handled barrel, an initial charge, triggering means for igniting said initial charge, and a projectile disposed in said barrel, said projectile comprising:

a casing capable of disintegrating upon sufficient impact;

a thrust charge arranged to be ignited by the initial charge to propel the projectile from the barrel;

an incendiary charge disposed within said casing;

a control charge arrangement disposed within said casing and including a burnable composition and an explosive charge arranged so that: said burnable composition is ignited to a burning condition by said thrust charge, ignites said incendiary charge prior to impact, continues to burn for a predetermined interval after ignition of said incendiary charge, and thereafter ignites said exlosive charge to disintegrate said casing, so that the expulsion of an ignited incendiary charge is assured.

28. Apparatus according to claim 27 wherein said projectile launcher further includes a muzzle lid formed of an elastic material, said lid being mounted on the muzzle of the barrel and including an end wall portion which retains said projectile against premature discharge from said barrel; said end wall portion comprising a series of elastically foldable parts which may be bent outwardly in response to the urgings of a projectile being launched by said propellant charge to permit discharge of said projectile.

* * * * *